United States Patent [19]

Aleck

[11] Patent Number: 4,625,537

[45] Date of Patent: Dec. 2, 1986

[54] LOCALIZED BOSS THICKENING BY COLD SWAGING

[75] Inventor: Benjamin J. Aleck, Jackson Heights, N.Y.

[73] Assignee: Grumman Aerospace Corporation, Bethpage, N.Y.

[21] Appl. No.: 655,531

[22] Filed: Sep. 28, 1984

Related U.S. Application Data

[63] Continuation-in-part of Ser. No. 447,261, Dec. 6, 1982, abandoned.

[51] Int. Cl.[4] ..... B21D 41/04

[52] U.S. Cl. ..... 72/367

[58] Field of Search ..... 72/61, 367, 370, 404, 72/416, 402, 403

[56] References Cited

U.S. PATENT DOCUMENTS

| | | | |
|---|---|---|---|
| 1,070,379 | 8/1913 | Summey | 72/404 |
| 1,319,837 | 10/1919 | Brinkman | 72/416 |
| 1,448,457 | 3/1923 | Liddell | 72/61 |
| 1,994,725 | 3/1935 | Offutt | 72/404 |
| 2,734,473 | 2/1956 | Reynolds | 72/305 |
| 3,136,052 | 6/1964 | Pickart | 72/367 |
| 3,292,414 | 12/1966 | Goeke | 72/367 |
| 4,095,450 | 6/1978 | Opland et al. | 72/367 |
| 4,131,007 | 12/1978 | Laundy | 72/367 |

FOREIGN PATENT DOCUMENTS

| | | | |
|---|---|---|---|
| 2260021 | 6/1974 | Fed. Rep. of Germany | 72/367 |
| 54223 | 4/1980 | Japan | 72/61 |
| 1054427 | 1/1967 | United Kingdom | 72/416 |

*Primary Examiner*—Lowell A. Larson

*Attorney, Agent, or Firm*—Richard G. Geib; Daniel J. Tick; Bernard S. Hoffman

[57] ABSTRACT

To reduce the length of a tube thickened by swaging and to provide acceptable efficiency in use of material and vessel length for a high performance pressure vessel, the tube is locally corrugated, then conventionally swaged and subsequently pressurized to remove the corrugations.

16 Claims, 13 Drawing Figures

LOCALIZED BOSS THICKENING BY COLD SWAGING

BACKGROUND OF THE INVENTION

This is a Continuation-In-Part of application Ser. No. 447,261, filed Dec. 6, 1982, for Swaging Apparatus and Method, and now abandoned.

The present invention relates to localized boss thickening by cold swaging. More particularly, the invention relates to the cold swaging of ductile tube ends to form thick bosses.

The presently common methods of converting tubing or deep-drawn shells into pressure vessels is by hot swaging or hot spinning the ends to form bosses. These techniques can be used to make short closures which are adequate when weight is not critical. For steel vessels, there is an economic problem that the scale formed on the inside of the vessel is costly to remove.

Cold swaging could be used, but the length of the closure is increased by the practical limitation of a 15° cone angle for the region joining the cylinder and its boss. Over this long length, the wall thickness is thickened whereas it should be thinned from structural considerations. Cold swaging is attractive because it would avoid the expense of cleaning the inside of the vessel associated with hot-forming techniques.

The primary objective of this invention is to provide a method of using cold-swaging, but avoiding the thickening and loss in volume associated with the 15° conical transition.

A major objective of the present invention is to permit cold-swaging the ends of tubing to form pressure-vessels whose ends can be threaded, without the weight penalties normally introduced. This invention teaches that this objective may be achieved, if prior to swaging the regions which are to be swaged, exclusive of the ends which will become bosses, and for which thickening is desirable, are corrugated. Such regions will be reduced in diameter during swaging by further bending of the corrugations, and without wall thickening. After the vessel ends are closed, the vessel is pressurized to unfold the corrugations. This will bring most of the vessel back to its original diamcter and thickness. This concept is exceptionally advantageous to users of my cryogenic bulge forming technique disclosed in U.S. Pat. No. 3,274,813, issued in September 1986 for expanding pressure vessels to cold work suitable materials to high strength levels.

The shape of the corrugations is selected to minimize the bending strains associated with producing, swaging, and removing the corrugations. For example, in principle, hundreds of corrugations could have been introduced around the circumference, but the bending strains associated with a 50% reduction in diameter would generally be unacceptably large, at reasonable thickness/diameter ratios.

The corrugating punches are conventional, but two corrugating restraints are required for this application. One restraint keeps the tube from expanding in diameter during corrugation. The second restraint keeps the tube-ends round while adjacent regions are corrugated.

The first restraint assures that the corrugated tube can enter the swaging tools. The second restraint assures that the boss region will be thickened during swaging.

The required swaging equipment is conventional in all respects. The invention relates to a method of using properly located and shaped corrugations prior to cold swaging to produce a thickening restricted to the boss region followed by pressurization to remove the corrugations. Thus, although the method of the invention is novel, U.S. Pat. Nos. 1,994,725 and 1,070,379 illustrate corrugating schemes which could be adapted. Furthermore, U.S. Pat. No. 1,448,487 illustrates the use of internal pressure to expand a pressure vessel.

The principal object of the invention is to provide a method for swaging an end of a ductile tubular blank to a small diameter boss, while thickening only the boss region by appropriate use of conventional equipment.

An object of the invention is to provide a method for swaging end portions of ductile tubular blanks in a manner whereby such end portions contain thickened bosses to be threaded to permit capping the resulting pressure vessel.

Another object of the invention is to provide a method including forming corrugations which permit swaging of the regions intermediate the end boss and the region of full cylinder diameter without causing the usual increase in thickness or decrease in cross-sectional length which normally accompanies reduction in diameter by swaging thereby permitting the original diameter and thickness to be restored by subsequent pressurization.

Still another object of the invention is to reduce the swaging work required in a method to obtain a large reduction in diameter at the boss.

The swaging effort for compaction of the corrugations is much less than for the compressing of a tube by the conventional swaging operation, in which the tube cross-section remains circular. Thus, the combined corrugation and swaging is economically attractive.

A basic premise of the invention is that the corrugated regions of the tube put into a swaging machine will be deformed to the same envelope as a circular tube would. The circular tube is reduced in diameter and increased in thickness. The corrugated tube is also reduced in envelope diameter, but the effect is achieved by bending the corrugations. No thickening results.

BRIEF SUMMARY OF THE INVENTION

In accordance with the invention, a method for localized boss thickening by cold swaging a substantially cylindrical member having an initially circular cross-section and an end, comprises the steps of corrugating the area of the member, which after swaging is the conical or ogival transition from adjacent the boss to the end of the swaged area to form a corrugated shape which is initially a figure eight in cross-section while the end region to be reduced in diameter and thickened is maintained circular in cross-section, cold swaging the circular end of the member to a small diameter, thickened so that it may function as the boss end of a pressure vessel, simultaneously swaging the corrugated transition region from the figure eight cross-section to a smaller envelope substantially kidney shape cross-section whereby it remains unthickened but bent to a smaller diameter, and subsequently pressurizing to remove the corrugations and to cause most of the deformed member to revert to its original size and thickness.

The member to which the method of the invention is applied may be an hour-glassed tube, the end region of which has been simultaneously reduced in diameter and thickness whereby the very end may be formed as a threadable boss.

The member may be seamless or welded.

The member may be shear-formed whereby the thickness of the member is controllable and the member is formable as a high performance pressure vessel.

The entire region of the member between the bosses may be corrugated to form a corrugated shape which is initially a figure eight in cross-section.

In accordance with the invention, a method of localized boss thickening by cold swaging of a substantially tubular member which is a surface of revolution having an end, comprises the steps of corrugating the area of the member, which after swaging is the conical or ogival transition from adjacent the boss to the end of the swaged area, to form a corrugated shape which is initially a figure eight in cross-section, cold swaging the circular end of the member to a small diameter, thickened so that it may function as the boss end of a pressure vessel thereby varying the cross-section of the member during swaging from the figure eight to a substantially kidney shape whereby most of the swaged area, except that at or adjacent the boss, remains unthickened and is bent to a smaller diameter, and subsequently pressurizing to remove the corrugations and causing most of the deformed member to revert to its original size and thickness.

The method of the invention is not limited to tubes of constant cross-section, but is also applicable to tubes whose ends have been reduced in thickness and diameter by hour-glassing. See U.S. Pat. No. 4,007,616. The advantage of applying the method to hour-glassed tubes is that the swaging required to obtain a very small diameter is reduced.

The method of the invention is also applicable to seamless, deep-drawn or welded tubes and to any of these shear-formed for the precise thickness control required in high-performance pressure vessels.

Standard corrugating apparatus for a ductile tubular blank having a substantially circular cross-section consists of a forming device for forming diametrically opposite troughs therein extending linearly along a portion of the length of the blank thereby providing a generally figure eight-shaped cross-section having narrow juncture portions between first and second generally circular cross-sectioned head portions. A basic requirement is an end plug to prevent the ends from corrugating. The conventional corrugating device has components for flattening the first and second head portions and pressing them toward each other thereby compacting the blank. Other components assure no increase in its transverse diameter.

Typically, the swaging device comprises symmetrically disposed identical dies each having a substantially horizontal, substantially planar outer surface, a first semicylindrical surface of predetermined diameter approximately the size of the diameter of the tube to be swaged, a second semicylindrical surface having a diameter smaller than the predetermined diameter (the desired outside diameter of the boss) and spaced from the first substantially semicylindrical surface, and a substantially semiconical surface extending between and joining the first and second substantially semicylindrical surfaces at a predetermined angle with the outer surface. When the formed tube is advanced longitudinally between the first and second dies as they are repeatedly and rapidly slightly separated and then caused to meet, the tube is compacted and reduced in diameter. The outer surfaces of the first and second dies are substantially parallel to each other and initially spaced a predetermined distance from each other and local regions of the blank are repeatedly reduced in diameter by an increment substantially equal to the distance between the outer surfaces. The predetermined angle is substantially a maximum of 15°. The semicylindrical and semiconical surfaces of the first and second dies are concave relative to the outer surfaces thereof.

The cross-section of the corrugated regions of the tube is changed during compaction of the tube. Thus, the overall envelope is a smaller circle and the two circular cross-sections of the figure eight become more kidney shaped. The depth of the central trough is simultaneously increased.

BRIEF DESCRIPTION OF THE DRAWINGS

In order that the invention may be readily carried into effect, it will now be described with reference to the accompanying drawings, wherein.

Figure 1:
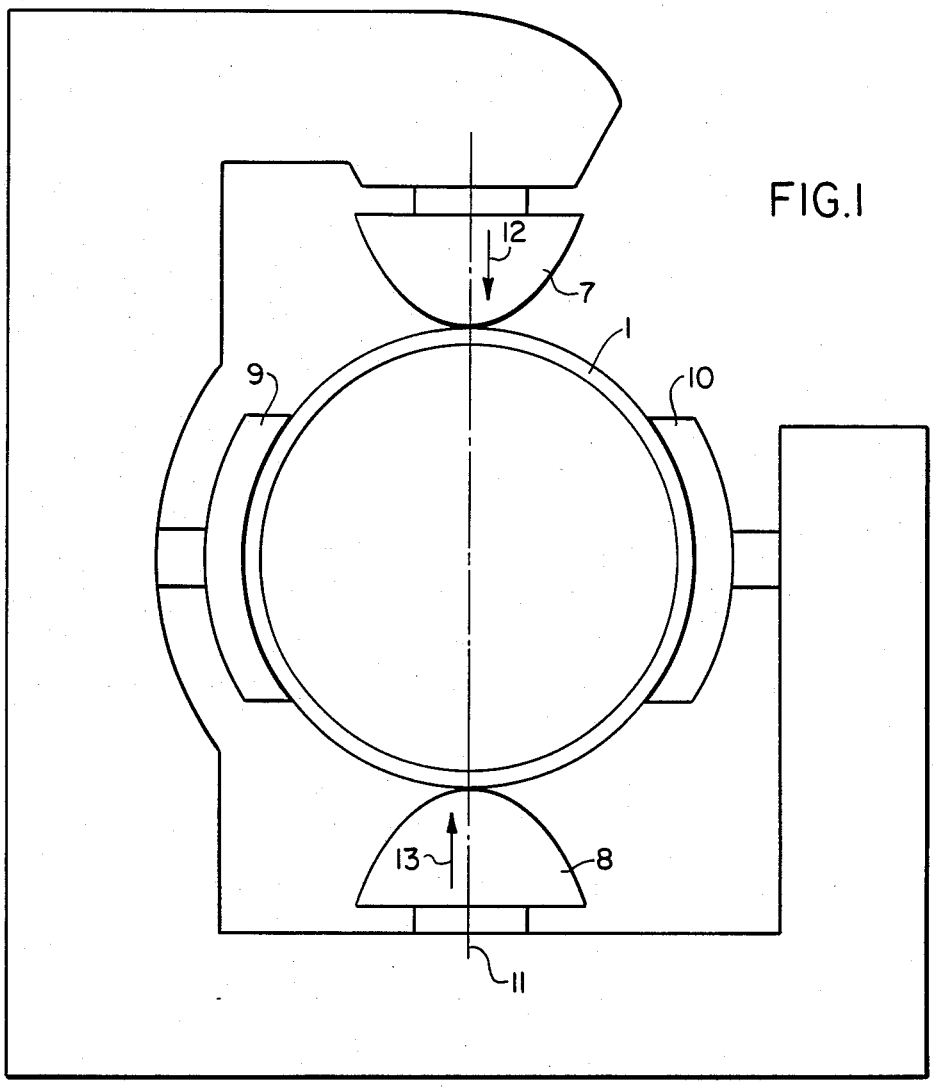
FIG. 1 is a schematic diagram of an embodiment of typical corrugating apparatus used in undertaking the invention.

In the drawings, a cylindrical tube starting shape has been selected in order to enhance the clarity of illustration. The generalization to other surfaces of revolution such as the hour-glassed tubes will be self-evident.

DETAILED DESCRIPTION OF PREFERRED EMBODIMENTS

The apparatus used in undertaken the method of the invention functions to compact a ductile tubular blank 1 (FIGS. 1, 3, 4 and 5) by initially corrugating the blank and then increasing the degree of corrugation by swaging.

The apparatus of the invention includes a forming device of the type shown in FIG. 1 which forms diametrically opposite troughs 2A and 2B in the blank 1 (FIG.

Figure 4:
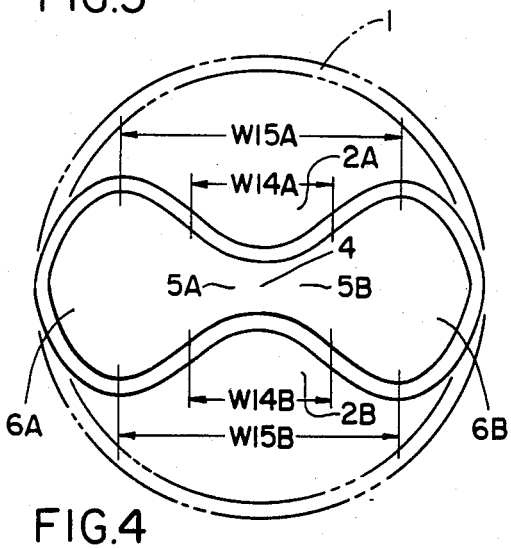
FIG. 4 is a cross-section of the blank of FIG. 3 locally corrugated by the forming device of FIG. 1, superposed on its original shape.

4) extending linearly along a portion of the length of said blank. This forms the region of the blank 1 into a generally figure eight-shaped cross-section, as shown in FIG. 4, having a substantially narrow juncture portion with spaced diametrically opposite first and second ends 5A and 5B, respectively. The cross-section in FIG. 4 also has first and second generally circular cross-sectional head portions 6A and 6B at the first and second ends 5A and 5B, respectively (also, see FIG. 2).

The forming device of FIG. 1 comprises a pair of spaced linearly positioned anvils 7 and 8 of any suitable type such as, for example, steam, pneumatic or hydraulically operated rams. A clamping device having a pair of spaced opposite clamps 9 and 10 releasably clamp the blank 1 in position between the anvils 7 and 8 in a manner whereby said anvils are symmetrical about a substantially vertical plane 11 through said blank (FIG. 1). The clamps 9 and 10 may be of any suitable type such as, for example, pressure, mechanical or magnetic clamps arranged to hold the blank 1 in position during the forming operation.

The anvils 7 and 8 are substantially partially sinusoidal in cross-section (FIG. 1) in a plane perpendicular to the plane 11 and the axis of the blank 1 and are driven toward each other, in the directions of arrows 12 and 13 (FIG. 1) in operation. The troughs 2A and 2B (FIG. 4) are concave and are formed by the anvils 7 and 8, respectively. Each of the troughs 2A and 2B initially has a predetermined minimum width in its area W14A and W14B, respectively as shown in FIG. 4, and a predetermined maximum width W15A and W15B, respectively (FIG. 4), in its area farthest from the corresponding area of the other. The initial shapes of the troughs 2A and 2B are the same. The initial minimum widths W14A and W14B are equal to each other and the initial maximum widths W15A and W15B are equal to each other.

Due to the shape of the corrugations or troughs 2A and 2B, the first and second head portions 6A and 6B are Joined via the trough regions 2A and 2B, as shown in FIG. 4, and are initially spaced a maximum distance from each other at, and equal to, the maximum width W15A and W15B of said troughs (FIG. 4).

Since the tube-ends are to be uncorrugated so that they will be thickened while reduced in diameter, expandable plugs, not shown in the FIGS., are installed in said tube-end regions prior to the corrugation procedure. They are then removed prior to the swaging operation.

Figure 2:
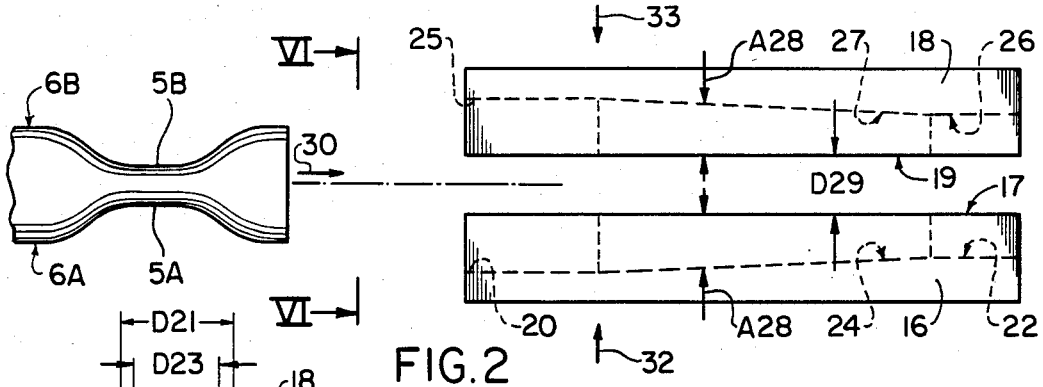
FIG. 2 is a schematic diagram, partly in section, of an embodiment of typical swaging apparatus used in undertaking the invention.
Figure 5:
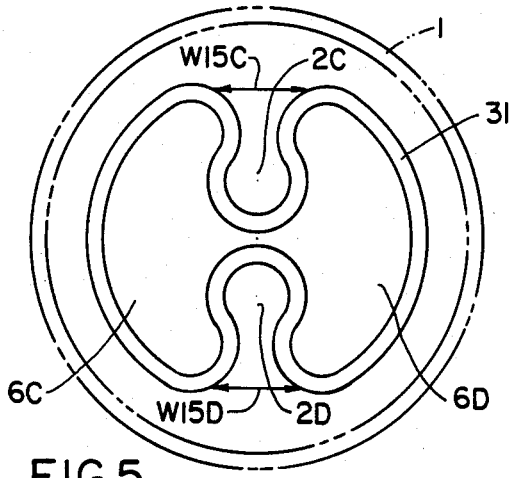
FIG. 5 is a cross-section of the formed blank of FIG. 4 with its diameter reduced by the swaging device of FIG. 2, the initial shape of the cross-section being superposed.

The apparatus of the invention includes a swaging device of known type, shown in FIG. 2, which flattens the first and second head portions 6A and 6B and presses them toward each other, in the manner shown in FIG. 5, thereby compacting the blank 1 and reducing its diameter.

The swaging device or tool has a first part or die 16 having a substantially horizontal, substantially planar outer surface 17 and a second part or die 18 having a substantially horizontal, substantially planar outer surface 19, as shown in FIG. 2. The first part or die 16 of the swaging tool has a first substantially semicylindrical surface 20 of predetermined diameter D21 (FIG. 6) and a second substantially semicylindrical surface 22 having a diameter D23 (FIG. 6) smaller than the diameter D21 and spaced from said surface 20. The first part or die 16 of the swaging tool also has a substantially semiconical surface 24 extending between and joining the first and second surfaces 20 and 22, respectively (FIGS. 2 and 6) at a predetermined angle A28, preferably substantially 15°, or less, with the outer surface 17. The second part or die 18 of the swaging tool has a first substantially cylindrical surface 25 of the diameter D21 (FIG. 6) and a second substantially semicylindrical surface 26 having the diameter D23 (FIG. 6) and spaced from said surface 25. The second part or die 18 of the swaging tool also has a substantially conical surface 27 extending between and joining the first and second surfaces 25 and 26 (FIGS. 2 and 6) at the predetermined angle A28, preferably substantially 15°, or less, with the first surface 19.

The first and second dies 16 and 18 are identical and the outer surfaces 17 and 19 thereof are initially parallel and spaced a predetermined distance D29 from each other, as shown in FIG. 2. The semicylindrical and conical surfaces 20, 22 and 24 of the first part or die 16 are concave relative to the outer surface 17 thereof. The semicylindrical and semiconical surfaces 25, 26 and 27 of the second part or die 18 are concave relative to the first surface 19 thereof.

The formed blank 3 is moved without resistance substantially horizontally in a substantially axial direction 30 between the first and second dies 16 and 18, respectively, as shown in FIG. 2, with the first head portion 6A in abutment with the surface 20 of said first die and the second head portion 6B in abutment with the surface 25 of said second die. After it contacts the semiconical region and then advances further in the direction 30, the cross-section of corrugated region will be shaped similarly to FIG. 5. The uncorrugated region at the end will be circular in cross-section with an outside diameter D23.

As shown in FIG. 5, the troughs 2C and 2D of the compacted blank 31 are reformed in cross-section into substantially back-to-back double S-type configuration and the head portions 6C and 6D are reformed in cross-section to substantially kidney configuration. The distances between peaks of the convex surfaces between the head portions 6C and 6D of the compacted blank 31 are decreased to W15C and W15D (FIG. 5).

Figure 6:
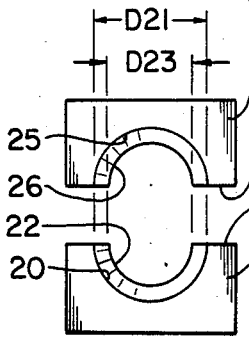
FIG. 6 is a view, taken along the lines VI—VI, of FIG. 2.
Figure 3:
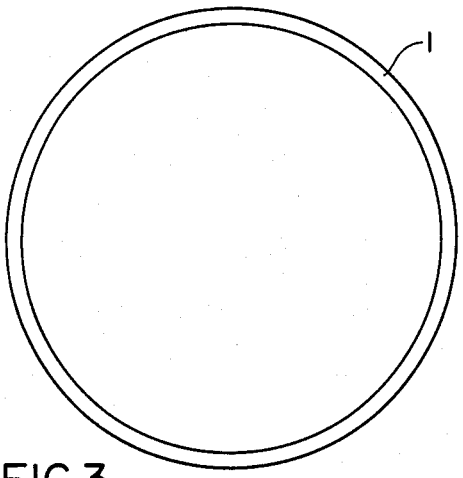
FIG. 3 is an axial view of a cylindrical ductile tubular blank prior to forming by the corrugating and swaging apparatus of the invention.

The method of the invention for swaging a ductile tubular blank may be undertaken by utilization of the forming device of FIG. 1 and the swaging device of FIGS. 2 and 6. The first step of the method of the invention is to corrugate a ductile tubular blank of substantially circular cross-section by forming diametrically opposite troughs in the tubular blank extending linearly along the length of the blank to form a generally figure eight-shaped cross-section having a narrow juncture portion with spaced diametrically opposite first and second ends and first and second generally circular cross-sectioned head portions at the first and second ends, respectively. The blank formed by the first, forming, step, is that shown in, and described with reference to, FIG. 4. The end region is prevented from corrugation by the insertion of removable end plugs (not shown in the FIGS.).

The second step of the method of the invention is swaging the formed blank 3 by pressing the first and second head portions toward each other thereby compacting the blank and reducing its diameter. The compacted blank as reformed by the second, swaging, step, is that shown in, and described with reference to, FIGS. 5 and 7F.

The first and second dies 16 and 18 are forced together, in the directions of arrows 32 and 33 of FIG. 2, until they abut at their first surfaces 17 and 19, respectively. The dies 16 and 18 then open and the formed tubular blank 3 advances in the direction of arrow 30

(FIG. 2), as the tubular blank rotates. The dies 16 and 18 then close to hammer the blank 3 to form a boss in the non-corrugated end region of said blank.

Figure 7A:
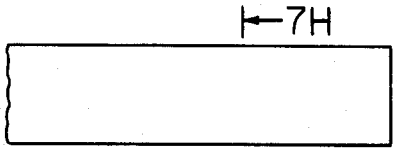
FIGS. 7A, 7B, 7C and 7D show the results of conventional swaging.
Figure 7H:
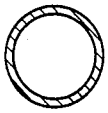
FIG. 7H is a sectional view, taken along the lines 7H—7H, of FIG. 7A.
Figure 7B:
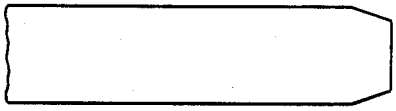
Figure 7C:
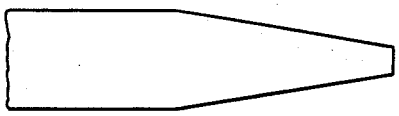
Figure 7D:
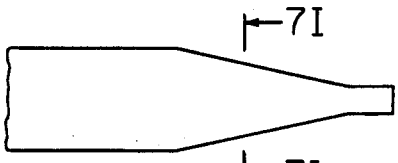
Figure 7I:
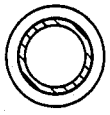
FIG. 7I is a sectional view, taken along the line 7I—7I, of FIG. 7D.
Figure 7E:
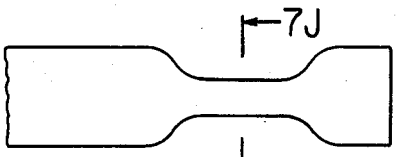
FIG. 7E illustrates the corrugated tubular blank.
Figure 7J:
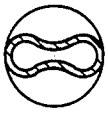
FIG 7J is a sectional view, taken along the lines 7J—7J, of FIG. 7E.
Figure 7F:
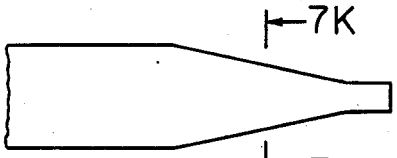
FIG. 7F illustrates the shaping of the corrugated tubular blank by swaging.
Figure 7K:
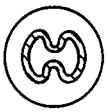
FIG. 7K is a sectional view, taken along the lines 7K—7K, of FIG. 7F.
Figure 7G:
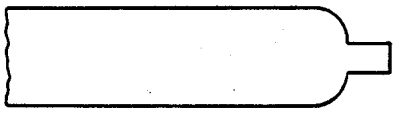
FIG. 7G shows the swaged blank after pressurization to remove the corrugations.

Upon subsequent hydrostatic pressurization, the corrugations or troughs substantially disappear and the tubular blank essentially resumes its initial configuration, except in the region of the boss, as shown in FIG. 7G.

FIG. 7A shows the original tubular blank 1 without corrugations and FIG. 7B illustrates the formed blank 3 after it has been partially swaged. FIG. 7C shows the blank 3 after it has been swaged to the end of the cone. FIG. 7D illustrates the blank 3 after swaging to form a boss 36.

FIG. 7E is a view of the formed blank 1 after corrugation but prior to swaging and FIG. 7F is a view of said blank after swaging. FIG. 7G is a view of the blank after pressurization to remove the corrugations.

To increase the available ductility performing operation of the member, intermediate annealing, preferably bright annealing steps, may be introduced as required.

Although shown and described in what are believed to be the most practical and preferred embodiments, it is apparent that departures from the specific methods and designs described and shown will suggest themselves to those skilled in the art and may be made without departing from the spirit and scope of the invention. I, therefore, do not wish to restrict myself to the particular constructions described and illustrated, but desire to avail myself of all modifications that may fall within the scope of the appended claims.

I claim:

1. A method for localized boss thickening by cold swaging a hollow surface of revolution having an end which will bedome a boss and an end region, said method comprising the steps of corrugating the area of said hollow surface of revolution, which after swaging is the transition, which is usually conical or ogival, from adjacent the boss to the end of the swaged area, to form a corrugated shape which is initially a figure eight in cross-section while the end region to be reduced in diameter and thickened is maintained circular in cross-section;

cold swaging the circular end of said hollow surface of revolution to a small diameter, thickened so that it may function as the boss end of a pressure vessel;

simultaneously swaging the corrugated region from said figure eight cross-section to a smaller envelope substantially kidney shape cross-section whereby it remains unthickened but bent to a smaller diameter; and subsequently pressurizing to remove most of the corrugations and to cause the region of the deformed hollow surface of revolution having the corrugations removed to revert to its original diameter.

2. A method as claimed in claim 1, wherein said hollow surface of revolution is an hour-glassed tube, the end region of which has been simultaneously reduced in diameter and thickness whereby the end may be formed as a threadable boss.

3. A method as claimed in claim 1, wherein said hollow surface of revolution is seamless.

4. A method as claimed in claim 1, wherein said hollow surface of revolution is welded.

5. A method as claimed in claim 1, wherein said hollow surface of revolution is shear-formed whereby the thickness of said hollow surface of revolution is controllable and said hollow surface of revolution is formable as a high performance pressure vessel.

6. A method as claimed in claim 1, wherein said hollow surface of revolution has spaced opposite ends which will become bosses and wherein the entire region of said hollow surface of revolution between the bosses is corrugated to form a corrugated shape which is initially a figure eight in cross-section.

7. A method as claimed in claim 1, wherein said hollow surface of revolution is a cylindrical member.

8. A method as claimed in claim 1, wherein said hollow surface of revolution is a substantially tubular member.

9. A method of localized boss thickening by cold swaging a hollow surface of revolution having an end which will become a boss and an end region, said method comprising the steps of corrugating the area of said hollow surface of revolution, which after swaging is the transition, which is usually conical or ogival, from adjacent the boss to the end of the swaged area, to form a corrugated shape which is initially a figure eight in cross-section;

cold swaging the circular end of said hollow surface of revolution to a small diameter, thickened so that it may function as the boss end of a pressure vessel simultaneously thereby varying the cross-section of the transition region of said hollow surface of revolution during swaging from said figure eight to a substantially kidney shape whereby most of the swaged area, except that at or adjacent said boss, remains unthickened and is bent to a smaller diameter; and subsequently pressurizing to remove most of the corrugations and causing the region of the deformed hollow surface of revolution having the corrugations removed to revert to its original diameter.

10. A method for localized boss thickening by cold swaging a hollow surface of revolution having an end which will become a boss and an end region, said method comprising the steps of corrugating the area of said hollow surface of revolution, which after swaging is the transition, which is usually conical or ogival, from adjacent the boss to the end of the swaged area, to form a corrugated shape having an initial shaped cross-section while the end region to be reduced in diameter and thickened is maintained circular in cross-section;

cold swaging the circular end of said hollow surface of revolution to a small diameter, thickened so that it may function as the boss end of a pressure vessel;

simultaneously swaging the corrugated region from said initial shaped cross-section to a smaller envelope of a different shaped cross-section whereby it remains unthickened but bent to a smaller diameter; and subsequently pressurizing to remove most of the corrugations and to cause the region of the deformed hollow surface of revolution having the corrugations removed to revert to its original diameter.

11. A method as claimed in claim 10, wherein said hollow surface of revolution is an hour-glassed tube, the end region of which has been simultaneously reduced in diameter and thickness whereby the end may be formed as a threadable boss.

12. A method as claimed in claim 10, wherein said hollow surface of revolution is seamless.

13. A method as claimed in claim 10, wherein said hollow surface of revolution is welded.

14. A method as claimed in claim 10, wherein said hollow surface of revolution is shear-formed whereby the thickness of said hollow surface of revolution is controllable and said hollow surface of revolution is formable as a high performance pressure vessel.

15. A method as claimed in claim 10, wherein said hollow surface of revolution has spaced opposite ends which will become bosses and wherein the entire region of said hollow surface of revolution between the bosses is corrugated to form a corrugated shape having said initial shaped cross-section.

16. A method of localized boss thickening by cold swaging a hollow surface of revolution having an end which will become a boss and an end region, said method comprising the steps of corrugating the area of said hollow surface of revolution, which after swaging is the transition, which is usually conical or ogival, from adjacent the boss to the end of the swaged area, to form a corrugated shape having an initial shaped cross-section;

cold swaging the circular end of said hollow surface of revolution to a small diameter, thickened so that it may function as the boss end of a pressure vessel simultaneously thereby varying the cross-section of the transition region of said hollow surface of revolution during swaging from said initial shaped cross-section to a different shaped cross-section whereby most of the swaged area, except that at or adjacent said boss, remains unthickened and is bent to a smaller diameter; and subsequently pressurizing to remove most of the corrugations and causing the region of the deformed hollow surface of revolution having the corrugations removed to revert to its original diameter.

* * * * *